US005845425A

United States Patent [19]

Leake et al.

[11] Patent Number: 5,845,425

[45] Date of Patent: Dec. 8, 1998

[54] PHOTOFRAME AND GIFT CARD COMBINATION

[76] Inventors: Michael J. Leake, 18 Corporate Plz., Attention Club 2000, Newport Beach, Calif. 92660; George Guon, 5209 Elkmont Dr., Rancho Palos Verdes, Calif. 90274; Albert O. Cota, 17475 Flanders St., Granada Hills, Calif. 91344

[21] Appl. No.: 836,217

[22] PCT Filed: Nov. 7, 1994

[86] PCT No.: PCT/US94/12869

§ 371 Date: May 6, 1997

§ 102(e) Date: May 6, 1997

[87] PCT Pub. No.: WO96/14629

PCT Pub. Date: May 17, 1996

[51] Int. Cl.[6] ..... G09F 1/00

[52] U.S. Cl. ..... 40/725; 40/124.06

[58] Field of Search ..... 40/124.01, 124.06, 40/124.11, 700, 721, 722, 723, 725, 765; 229/92.8; 206/232

[56] References Cited

U.S. PATENT DOCUMENTS

| | | | |
|---|---|---|---|
| 3,234,676 | 2/1966 | Colicki et al. | 40/124.06 |
| 3,583,729 | 6/1971 | DeGroot . | |
| 3,755,925 | 9/1973 | Court . | |
| 4,203,516 | 5/1980 | Stonoga et al. | 229/92.8 X |
| 4,492,306 | 1/1985 | Cooper et al. | 206/232 X |
| 4,711,348 | 12/1987 | Schluger | 206/232 X |
| 5,038,930 | 8/1991 | Holtkamp, Jr. | 206/232 |
| 5,081,776 | 1/1992 | Stone et al. | 40/124.11 |
| 5,207,717 | 5/1993 | Manning . | |
| 5,209,349 | 5/1993 | Porter et al. | 206/232 |
| 5,232,087 | 8/1993 | Schluger | 40/124.06 X |

FOREIGN PATENT DOCUMENTS

| | | | |
|---|---|---|---|
| 5246939 | 4/1977 | Japan | 40/725 |
| 1400020 | 7/1975 | United Kingdom . | |

*Primary Examiner*—Joanne Silbermann
*Attorney, Agent, or Firm*—Albert O. Cota

[57] ABSTRACT

A photoframe™ and gift card combination (10) that consists of a frame (12) having integrally attached an overlapping back cover (30). The cover (30) is divided into three panels: an outward panel (32) having a first photo cutout (32G), a center panel (34) having a second photo cutout (34G) and a U-shaped photo retainer (42), and an inward panel (38) that attaches to the frame (12). When the outward panel (32) is folded over and attached to the center panel (34), the two photo cutouts (32G, 34G) are in alignment and the photo retainer (42) forms a composite photo retaining section (44) having a photo slot (44B). Into the photo slot (44B) is inserted a photo such as a trading card. When the composite photo retaining section (44) is separated from the frame (12) and angled outwardly the combination (10) can be set on a flat surface to allow both the picture in the frame and the trading card in the section (44) to be viewed simultaneously. To enhance be aesthetic of the combination (10), indicia and other embellishments may be added to either or both sides of the composite photo retaining section (44).

25 Claims, 4 Drawing Sheets

PHOTOFRAME AND GIFT CARD COMBINATION

TECHNICAL FIELD

The invention pertains to the general fields of greeting cards and photo frames and more particularly to an integrated gift item that combines both a photo frame and a gift card having a photo retaining section.

BACKGROUND ART

The giving of photos and/or greeting cards as gifts has long been used and accepted by both individuals and businesses as an expression of love, thanks and to communicate personal messages. Cards are also commonly used to make various types of announcements, such as for new products, business notices, graduations, birthdays and marriages. In many cases, to personalize or to enhance the significance of a gift card, a photograph or the like is inserted into the gift card or the two items are given separately.

For the past few years, the collecting, trading and giving of trading cards, such as baseball and football cards has become so popular that there are now stores that exclusively deal in these trading cards. There are numerous ways that trading cards can be displayed, with the most popular being a binder having plastic inserts that typically accept nine cards per binder. A formal way for displaying and giving of a single card, has been lacking in the prior art until the introduction of the instant invention. The inventive PHOTOFRAME™ and gift card combination which includes a slot into which a trading card may be inserted, is particularly suited for aesthetically displaying and retaining trading cards of significant value or rarity. The invention also allows the option of having a larger photograph of the person portrayed in the trading card or a related subject to be inserted into the frame section of the invention.

A search of the prior art was conducted in several department stores, speciality stores, drug stores, catalogs and business gift companies to determine what types and design configurations of photo frame and greeting card combination, if any, were available. This search disclosed that there were no photo slotted gift cards that were integrally attached to a photo frame. Further, no such gift item was located where the frame can be held upright by either the structure of the card or an integrated frame stand. Thus, the prior art did not disclose any items that read directly on the claims of the instant invention.

This application is related to the applicant's copending application Ser. No. 08/ filed 1993 and entitled: GREETING CARD AND PICTURE FRAME COMBINATION.

DISCLOSURE OF THE INVENTION

The PHOTOFRAME™ and gift card combination is so named to indicate that within a single article of manufacture is included a photoframe and an integral gift card. The gift card section includes a photo retaining section having a photo slot into which a small photo, such as a trading card, may be inserted that compliments a photograph inserted into the frame. The PHOTOFRAME™ and gift card combination in its basic form and function consists of two major elements: a frame and an overlapping back cover.

The frame has a lower edge, an inward section that further has a front side, a back side, an outer edge and a lower edge. The frame also includes means for having a photo inserted and retained therein.

The overlapping back cover consists of an integrated outward panel, a center panel and an inward panel. The outward panel has a first side, a second side, a first side edge, a second side edge and a first photo cutout therethrough. The center panel has a first side, a second side and a first side edge. The first side edge of the center panel is integrally attached to the second side edge of the outward panel by a cover crease. The center panel further has a second photo cutout therethrough that is in alignment with the first photo cutout when the outward panel overlaps the center panel. The inward panel has a first side and a first side edge. The first side edge is integrally attached to the second side edge of the center panel by a frame crease that is located adjacent to the outer edge of the frame's inward section. The first side of the inward panel is attached to the backside of the frame by an attachment means.

The photo retainer has inner dimensions that exceed the dimensions of the photo cutout and is attached to the second side of the center panel. When the outward panel is folded over the cover crease and its second side is attached to the photo retainer, a composite photo section is formed that includes a photo slot. Into this photo slot may be inserted and retained a photo or a trading card that can be viewed from either side of the photo section. When the photo section is angularly opened and displaced from the frame, the lower edges of the photo retaining section and the frame may be placed upon a flat surface to allow the front side of the PHOTOFRAME™ and the first side of the gift card to be viewed.

There is no limitation to the type of material or the size of a rectangular frame that can be used to implement the invention. The overlapping back cover can also be made of most any type of thin material that can be creased and folded. However, a thin cardboard or a thin opaque plastic is preferred. Additionally, for aesthetics, the overlapping back cover may be colored or textured to compliment the color and texture of the frame and further embellishment and indicia, representing the purpose of the card, may be added to the first and/or second sides of the composite photo section.

The indicia, the size of the photo insert and photo slot can be made to accommodate most any size photo commensurate with the overall size of the cover. However, because of the popularity of baseball, football and other subject trading cards, the photo insert is preferably sized to accommodate trading cards. When a trading card is inserted, the photo in the frame section may consist of a larger complimentary photo or a larger photo of the player who is featured on the trading cards. Since some trading cards have a high monetary and trading value, these cards may be encased in a hermetically sealed plastic cover before they are inserted into the photo slot.

Further, enhancements to the invention include a grooved wall hanger for hanging the photoframe and gift card combination to a wall; a friction hinge which is attached to the back side of the frame's lower section. The hinge allows the photoframe and gift card combination to be placed angled upon a flat surface; and a luminescent panel that attaches to the back sides of a clear plastic or glass frame. The luminescence panel allows the photoframe and gift card combination to function as a night light.

In view of the above disclosure it is the primary object of the invention to produce an article of manufacture that combines the benefits of a frame with a gift card and in particular, a gift card that allows the safe keeping and viewing of a trading card. In addition to the above primary object it is also an object of the invention to provide a gift item that:

since the gift card is attached to a frame, there is a tendency for the recipient of the card to keep the card longer, provides an aesthetic method of protecting and viewing valuable trading cards, allows the trading card to be easily removed from and inserted into the frame, allows the gift card to hold up the frame, is unique, can be made with an endless combination of phrases, symbols and pictures, has applicability for commercial advertising as well as gift giving, is sized to be mailed, is cost effective from both a manufacturer and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
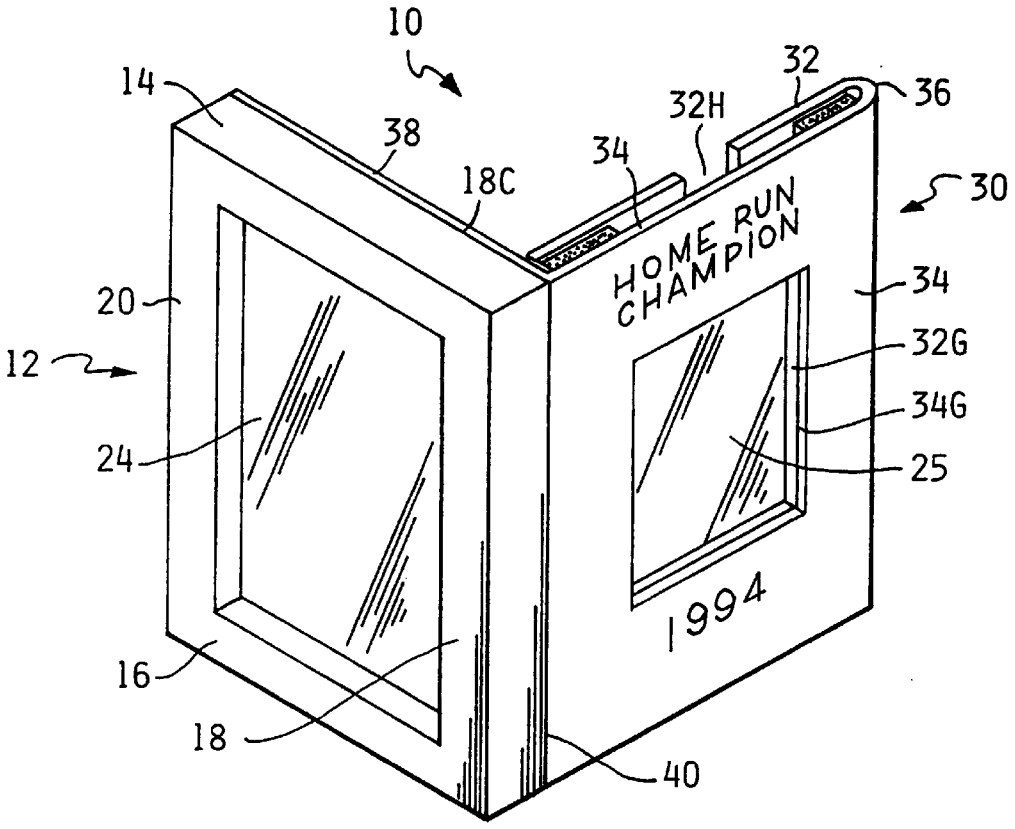
FIG. 1 is a perspective view of the photoframe and gift card combination.

The best mode for carrying out the invention is presented in terms of a preferred embodiment that combines within a single article of manufacturing a gift card that is integrally attached to a frame. The gift card section is particularly adapted to include a photo or a trading card and the frame section a photo that compliments the card photo or trading card. The preferred embodiment of the photoframe and gift card combination 10, as shown in FIGS. 1–17 is comprised of two major elements: a frame 12 and an overlapping back cover 30 as shown in FIG. 1.

Figure 2:
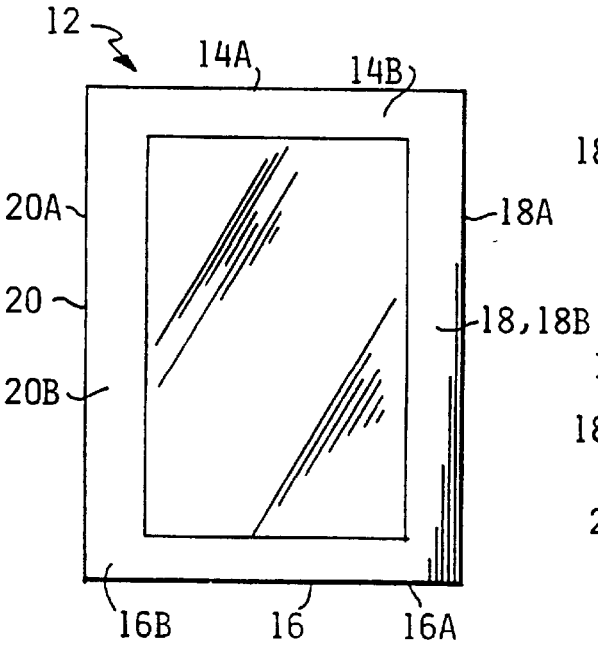
FIG. 2 is a front elevational view of the frame.
Figure 3:
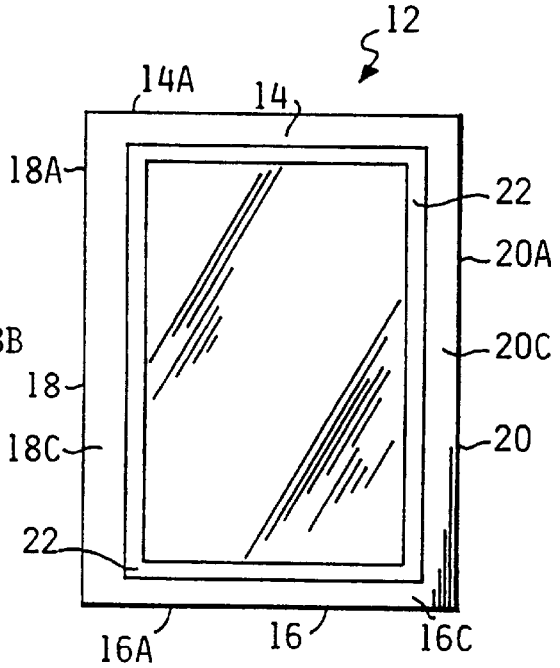
FIG. 3 is a back elevational view of the frame.

The frame 12 which can be manufactured of most any material, consists of an upper section 14, a lower section 16, an inward section 18 and an outward section 20 as shown in FIGS. 2 and 3. The upward section has an upper edge 14A, a front side 14B and a back side 14C; the lower section 16 has a lower edge 16A, a front side 16B and a back side 16C; the inward section 18 has an outer edge 18A, a front side 18B and a back side 18C and the outward section 20 that has an outer edge 20A, a front side 20B and a back side 20C. From the back sides of the frame is formed a perimeter step area 22 that allows a photo to be inserted and retained therein by a retaining means. Before a photo is placed into the frame, a protective translucent material 24 may be inserted into the perimeter step area.

Figure 4:
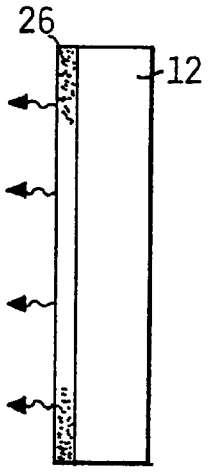
FIG. 4 is a side elevational view of a frame having its front sides painted with photoluminescent paint.
Figure 5:
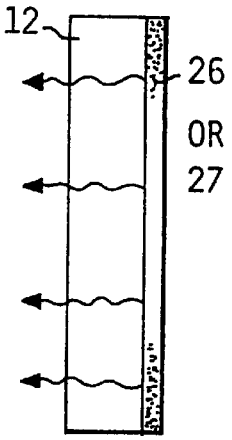
FIG. 5 is a side elevational view of a frame made of a clear material and having a photoluminescent paint or tape attached to its back side.
Figure 6:
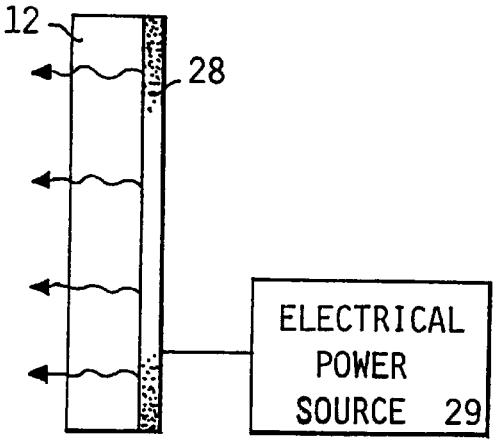
FIG. 6 is a side elevational view of a frame made of a clear material and having an electrically powered electoluminescent panel attached to its back sides.

In a distinctive embodiment of the frame 12, the front sides of the frame 12 sections 14,16,18 and 20 are painted with a photoluminescent paint 26 as shown in FIG. 4. Alternatively, the frame is constructed of a translucent or transparent material such as glass or acrylic plastic as shown in FIG. 5. To the back side of the frame sections 14,16,18 and 20 is painted the photoluminescent paint 26 or a photoluminescent tape 27 is attached as shown in FIG. 5. The photoluminescent paint 26 or tape 27 is designed to luminesce for several hours after the paint or tape has been exposed to a light source, such as sunlight or an incandescent light bulb. In lieu of the photoluminescent paint or tape, an electroluminescent panel 28 can be attached to the back sides 14,16,18 and 20 of a frame 12 that is also constructed of a translucent or transparent material. The electroluminescent panel 28 as shown in FIG. 6, requires the application of an electrical power source 29, which allows the panel 28 to luminesce as long as power is applied. With the inclusion of the luminescent paint 26, tape 27 or the electroluminescent panel 28, the photoframe and gift card combination 10 can function as a night light or to add to the aesthetics of the basic design.

Figure 7:
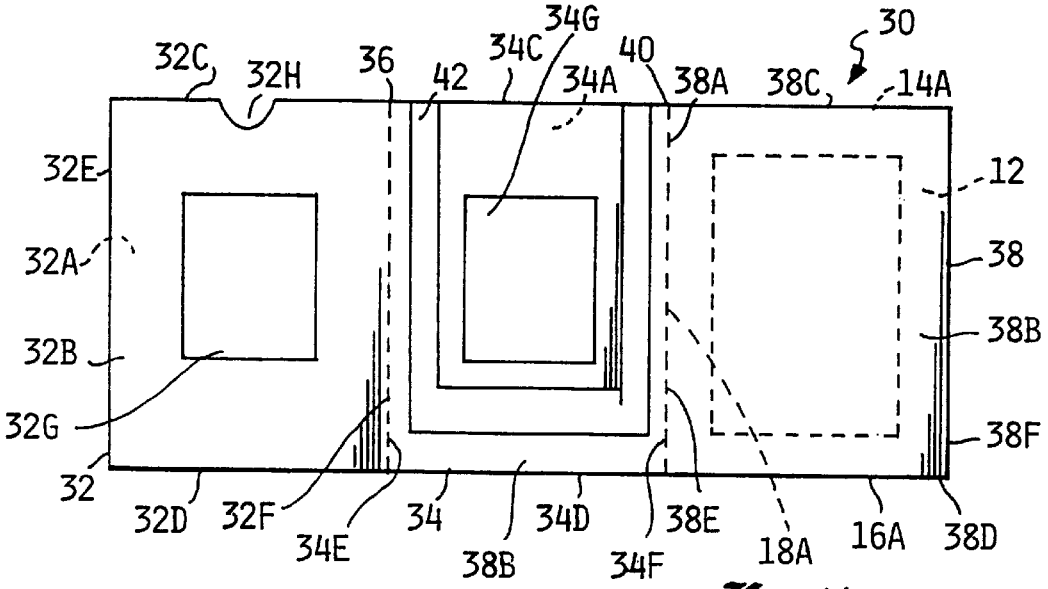
FIG. 7 is an elevational view of the overlapping back cover fully extended with its inward panel attached to the back sides of the frame.

The second element of the photoframe and gift card combination 10 is the overlapping back cover 30 which is preferably made of a thin rigid material such as cardboard or plastic. The cover 30 is comprised of: an outward panel 32, a center panel 34 and an inward panel 38 as shown in FIG. 7. The outward panel further consists of a first side 32A, a second side 32B, an upper edge 32C, a lower edge 32D, a first side edge 32E, a second side edge 32F. The outward panel also has a first photo cutout 32G therethrough and may also include a finger opening 32H centered at its upper edge 32C over the first photo cutout 32G. The opening allows a picture or trading card inserted into a photo slot described infra, to be easily removed.

The center panel 34 has a first side 34A, a second side 34B, an upper edge 34C, a lower edge 34D, a first side edge 34E, and a second side edge 34F. The first side edge 34E is integrally attached to the second side edge 32F of the outward panel 32 by a cover crease 36. The center panel further includes a second photo cutout 34G therethrough that is in alignment with the first photo cutout 32G when the outward panel 32 overlaps the center panel 34.

The inward panel 38 has a first side 38A, a second side 38B, an upper edge 38C, a lower edge 38D, a first side edge 3SE and a second side edge 38F. The first side edge 383 is integrally attached to the second side edge 34F of the center panel 34 by a frame crease 40. The frame crease 40 is located adjacent to the outer edge 18A of the inward section 18 of the frame 12 and has its first side 38A attached to the back sides of said frame 12 by an attachment means that preferably consists of an adhesive. When so attached, the upper edge 38C of the inward panel 38 is in alignment with the upper edge 14A of the frame's upper section 14 and the lower edge 38D of the inward panel 38 is in alignment with the lower edge 16A of the frame's lower section 16.

Figure 8:
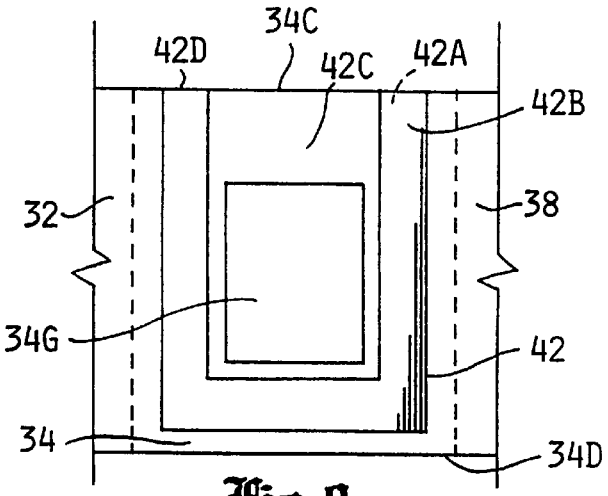
FIG. 8 is a partial elevational view which details the U-shaped photo retainer attached to the center panel of the overlapping back cover.

To complete the structure of the overlapping back cover 30, a U-shaped photo retainer 42 is employed. As shown best in FIGS. 7 and 8, this U-shaped photo retainer 42 has a front side 42A, a back side 42B and an opening 42C having inner dimensions that exceed the dimensions of the photo cutouts 32G,34G. The photo retainer 42 as shown beat in FIG. 8, is attached with the upper edges 42D of its opening 42C adjacent the upper edge 34C of the center panel 34. The front side 42A is attached against the second side 34B of the center panel 34 by an attachment means which preferably consists of an adhesive.

Figure 9:
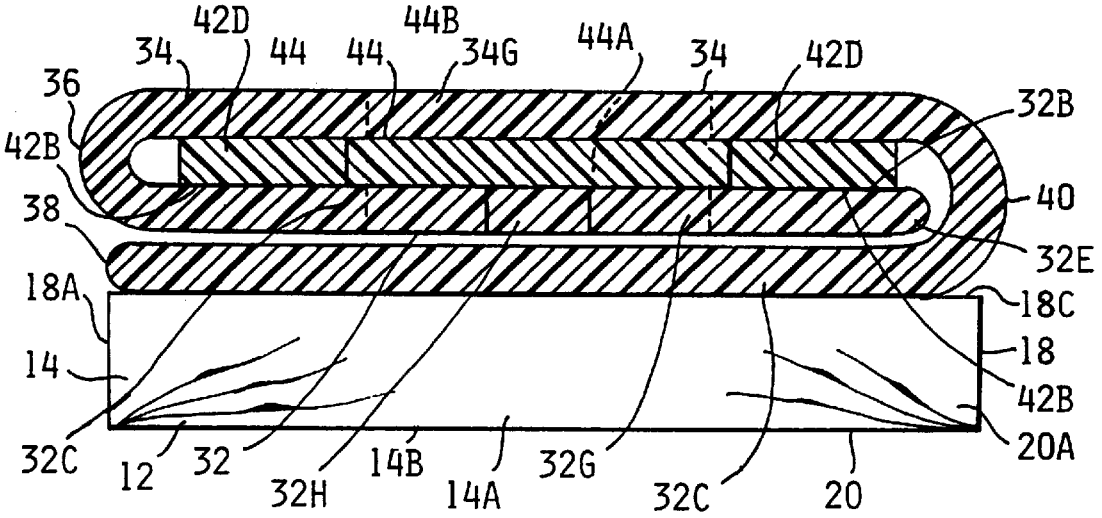
FIG. 9 is a top sectional view showing the overlapping back cover in its folded configuration with a full-sized inward panel attached to the back sides of the frame.

As shown in FIG. 9, when the outward panel 32 is folded at the cover crease 36, so that its second side 32B rests over the back side 42B of the photo retainer 42, a composite photo retaining section 44 is formed. The section 44 has a lower edge 44A and an upper photo slot 44B into which is removably inserted and retained a photo or a trading card that can be viewed from either side of the photo retaining section 44. To protect the trading card or photo, they may be enclosed in a protective transparent cover 25, as shown in FIG. 1, before they are inserted into the photo slot 44B. Further, to provide additional protection, especially for valuable trading cards, the transparent cover may include a means for being hermetically sealed. Also, to enhance the aesthetics and to indicate the purpose of the photoframe and gift card combination 10, the composite photo retaining section can include on either side, embellishment and/or indicia as shown in FIG. 1.

Figure 10:
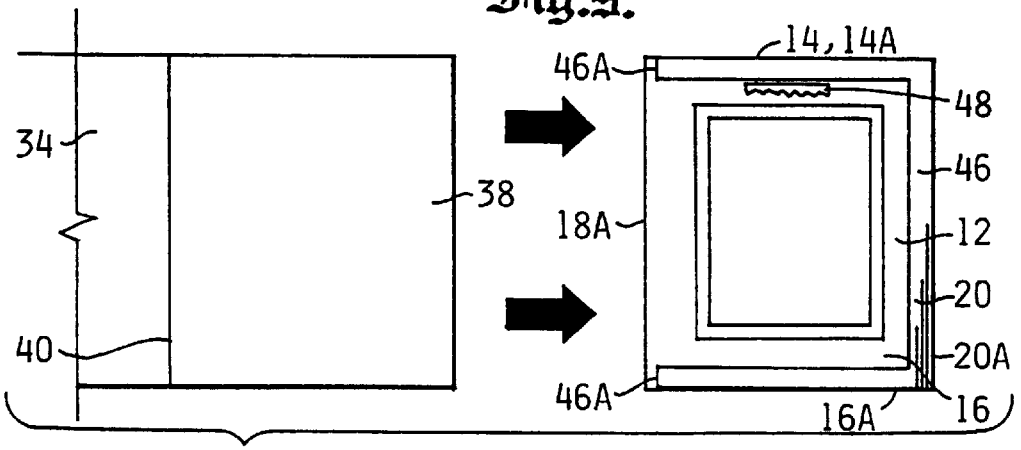
FIG. 10 is an elevational back view showing a channel attached to the upper section, lower section and outward section of the frame and is sized to accept and retain the inward panel of the overlapping back cover.
Figure 11:
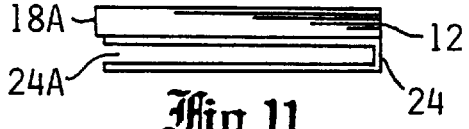
FIG. 11 is a top plan view of the channel attached to the frame.

The inward panel 38 as shown in FIGS. 1 and 8, is preferably sized to cover the entire back side of the frame 12 and be attached thereto by an attachment means. When so sized, the inward panel 38 functions as a frame backing. The inward panel may be attached thereto by an adhesive or by two other methods. The first method as shown in FIGS. 10 and 11, comprises a rigid channel 24 that is attached adjacent the upper edge 14A of the upper section 14, the lower edge 16A of the lower section 16 and to the outer edge 20A of the outer section 20 of the frame 12. When so attached, a channel opening 24A is created adjacent the outer edge 18A of the frame's inward section 18. This channel and opening allows the inward panel 38 to be inserted and held therein by friction.

Figure 12:
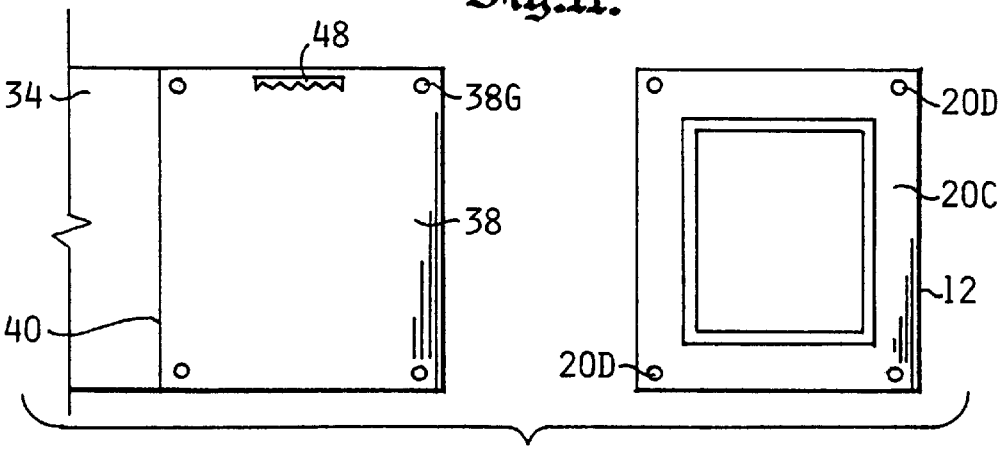
FIG. 12 is an elevational back view showing a plurality of male detents attached to the back sides of the frame and a corresponding set of aligned female detents or bores located on the inward panel of the overlapping back cover.

The second inward panel 38 attachment method comprises, as shown in FIG. 12, a male detent 20D located on at least two corners of the back side of said frame 12. To compliment the male detents, a female detent or bore 38G is located on at least two aligned corners of the inward panel 38. When the female detent or bore 38A are pressed into the corresponding male detents 20D, the inward panel 38 is attached to the frame 12.

Figure 13:
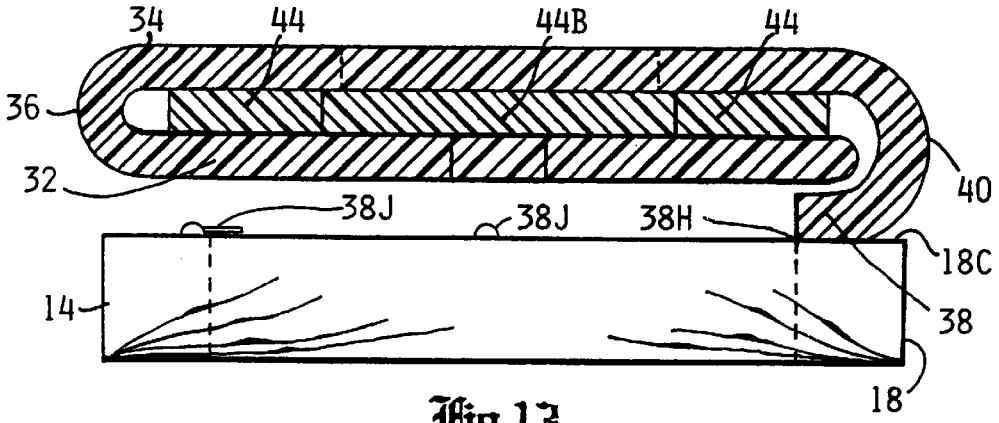
FIG. 13 is a top sectional view showing the overlapping back cover in its folded configuration with a narrow width, inward panel attached to the back side of the framed's inward section.
Figure 14:
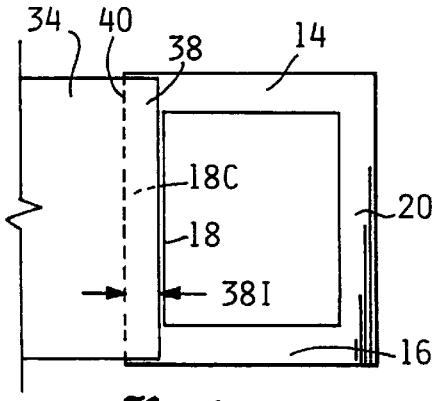
FIG. 14 is an elevational back view showing the narrow width back panel attached to the back side of the frame's inward section.

In lieu of the full sized inward panel 38, as shown in FIG. 9, the inward panel 38 may instead be sized to have a width 38I as shown in FIG. 14, that is sized to fit and be attached only to the back side 18C of the inward section 18 of the frame 12 as shown in FIG. 13 and 14. In this case, the inward panel would be preferably attached by means of an adhesive 38H. Also, to maintain the picture within the frame structure, two or three picture clips 38J as shown in FIG. 13, may be attached to the back side sections of the frame 12.

The photoframe and gift card combination 10 has provisions to allow it to be set upright on its edges, to be hung on a wall or propped-up by means of a stand.

Figure 15:
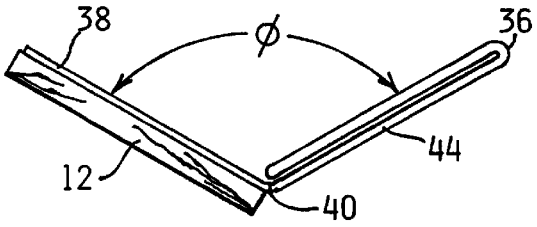
FIG. 15 is a top plan view showing the composite photo retaining section of the overlapping back cover displaced by an angle $\phi$ from the back sides of the frame.

To allow the combination 10 to be set upright on its edges, as shown in FIG. 15, the composite photo retaining section 44 is angularly displaced by an angle $\phi$ from the inward panel 68 attached to the frame 12. The lower edges 32D,34D and 38D of the overlapping back cover 30 and the lower edge 16A of the frame 12 are then placed on a flat surface to allow the combination 10 to remain upright and viewed.

To allow the combination 10 to be hung on a wall, a grooved wall hanger 48 is utilized. The hanger 48 as shown in FIG. 10 may be attached to the back side 14C of the upper section 14 of the frame 12. If the inward panel 38 completely covers the frame 12, the hanger 48 is attached to the outer surface of the panel 38 as shown in FIG. 12. In either case, the hanger 48 allows the photoframe and gift card combination 10 be hung on a wall with the front side of the frame 12 and the first side of the photo retaining section 44 exposed to a viewer.

Figure 16:
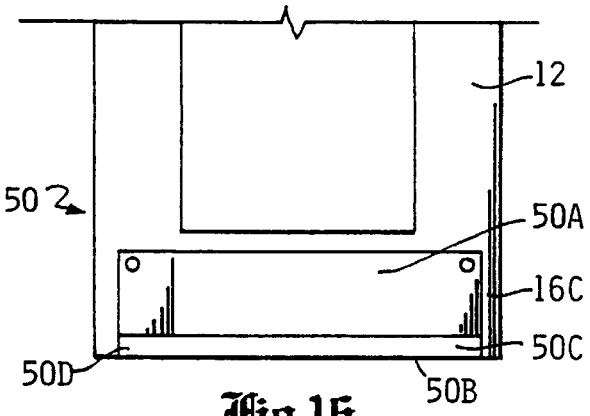
FIG. 16 is an elevational back view showing the location of a frame support hinge.
Figure 17:
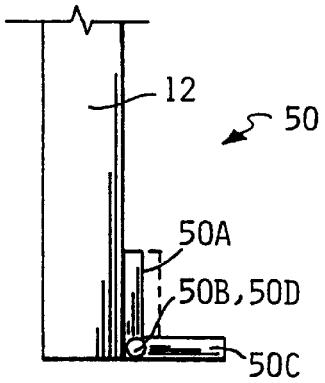
FIG. 17 is a side elevational view showing the location of the frame support hinge in an outward frame holding position and in dashed lines, in a stowed position.

To allow the combination 10 to be propped-up, a frame support hinge 50 is used. This hinge as shown in FIGS. 16 and 17, consists of a vertical member 50A and a horizontal member 50C. The vertical member 50A consists of a lower edge 50B and has a length that is substantially equal to the length of the frame's lower section 16 as shown in FIG. 16. The horizontal member 50C has an inward edge 50D that is frictionally hinged to the lower edge 50B of the vertical member 50A. The vertical member 50A is attached, by an attachment means, to the back side 16C of the frame's lower section 16, either directly to the frame or via the inward panel 38. When so attached, the horizontal member 50C can be angularly positioned and held there by friction, to allow the photoframe and gift card combination 10 to be placed upon a flat surface. When the combination 10 is being stored or is in transport, the horizontal member 50C can be positioned upward, against the vertical member 50A as shown by the dashed lines in FIG. 17.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

We claim:

1. A photoframe and gift card combination comprising:

a) a frame having a lower edge, an inward section that includes a front side, a back side, an outer edge and a lower edge and means for having a photo inserted and retained therein, b) an overlapping back cover comprising:

(1) an outward panel having a first side, a second side, a first side edge, a second side edge and a first photo cutout therethrough, (2) a center panel having a first side, a second side and a first side edge, where the first side edge is integrally attached to the second side edge of said outward panel by a cover crease, said center panel further having a second photo cutout therethrough that is in alignment with the first photo cutout when said outward panel overlaps said center panel, (3) an inward panel having a first side and a first side edge, where the first side edge is integrally attached to the second side edge of said center panel by a frame crease that is located adjacent the outer edge of said frame's inward section, where the first side of said inward panel is attached to the backside of said frame by an attachment means, and, (4) a photo retainer having inner dimensions that exceed the dimensions of the photo cutouts and that is attached, by an attachment means, to the second side of the center panel, where when the outward panel is folded over the cover crease and its second side is attached, to the photo retainer by an attachment means, a composite photo section is formed having a lower edge and an upper photo slot into which is removably inserted and retained a photo or trading card that can be viewed from either side of the photo section, where when the photo section is angularly displaced, the respective lower edges of said photo retaining section and said frame may be placed upon a flat surface to allow the front side of said photoframe and the first side of said gift card to be viewed.

2. The combination as specified in claim 1 wherein said overlapping back cover is made of a thin rigid material.

3. The combination as specified in claim 1 wherein said inward panel attachment means comprises an adhesive.

4. The combination as specified in claim 1 further comprising a frame support hinge comprising:

a) a vertical member having a lower edge and a length substantially equal to the length of said frame's lower section, and b) a horizontal member having an inward edge that is frictionally hinged to the lower edge of the vertical member, where when the vertical member is attached, by an attachment means, to the back side of said frame's lower section, the horizontal member can be angularly positioned to allow said photoframe and gift card combination to be placed upon a flat surface, and when said combination is being stored or is in transport, the horizontal member can be positioned upward, against the vertical member.

5. The combination as specified in claim 1 further comprising a protective translucent material inserted into said frame prior to the insertion of a photo.

6. The combination as specified in claim 1 wherein the composite photo section can include on either side, embellishment and indicia that indicates the purpose of said photoframe and gift card combination.

7. A photoframe and gift card combination comprising:

a) a frame comprising an upper section having an upper edge, a front side and a back side; a lower section having a lower edge, a front side and a back side; an inward section having an outer edge, a front side and a back side and an outward section having an outer edge, a front side and a back side, from where the back sides of said frame is formed a perimeter step area that allows a photo to be inserted and retained therein by a photo retaining means, b) an overlapping back cover comprising:

(1) an outward panel having a first side, a second side, an upper edge, a lower edge, a first side edge, a second side edge and a first photo cutout therethrough, (2) a center panel having a first side, a second side, an upper edge, a lower edge, a first side edge, and a second side edge, where the first side edge is integrally attached to the second side edge of said outward panel by a cover crease, with said center panel further having a second photo cutout therethrough that is in alignment with the first photo cutout when said outward panel overlaps said center panel, (3) an inward panel having a first side, a second side, an upper edge, a lower edge, a first side edge and a second side edge, where the first side edge is integrally attached to the second side edge of said center panel by a frame crease that is located adjacent the outer edge of the inward section of said frame and having its first side attached to the back side of said frame by an attachment means, where when so attached, the upper edge of said inward panel is in alignment with the upper edge of said frame's upper section and the lower edge of said inward panel is in alignment with the lower edge of said frame's lower section, and (4) a U-shaped photo retainer having a front side, a back side and an opening having inner dimensions that exceed the dimensions of the photo cutouts, where the retainer is attached with the edges of its opening adjacent the upper edge of said center panel and with its front side attached against the second side of said center panel, where when the outward panel is folded at the cover creases so that its second side rests over the back side of the photo retainer, a composite photo retaining section is formed having a lower edge and an upper photo slot into which is removably inserted and retained a photo or trading card that can be viewed from either side of the photo retaining section, where when the composite photo retaining section is angularly displaced by an angle $\phi$ from the outward section of said frame, and the lower edges of the photo retaining section and said frame are placed upon a flat surface, said photoframe and gift card combination remains upright and can be viewed.

8. The combination as specified in claim 7 wherein said overlapping back cover is made of a thin rigid material.

9. The combination as specified in claim 7 wherein said outer panel further having a finger opening centered at its upper edge over the first photo cutout, where said opening allows a picture or trading card inserted into the photo slot to be easily removed.

10. The combination as specified in claim 7 wherein said inward panel is sized to cover the entire back sides of said frame and be attached thereto by an attachment means, to allow said inward panel to function as a frame backing.

11. The combination as specified in claim 10 wherein said inward panel attachment means comprises a rigid channel attached adjacent the upper edge of the upper section, the lower edge of the lower section and to the outer edge of the outer section of said frame, where when so attached, a channel opening is created adjacent the outer edge of the inner section of said frame that allows said inward panel to be inserted and held therein by friction.

12. The combination as specified in claim 10 wherein said inward panel attachment means comprises:

a) a male detent located on at least two corners of the back side of said frame, and b) a female detent or bore located on at least two aligned corners of the first side of said inward panel, where when the female detent or bores are pressed into the corresponding male detents, the inward panel is attached to said frame.

13. The combination as specified in claim 7 wherein said inward panel has a width equal to the width of said frame's inward section and is attached to the backside of the inward section by means of an adhesive.

14. The combination as specified in claim 7 further comprising a grooved wall hanger attached to the back side of the upper section of said frame, where said hanger allows said photoframe and gift card combination to be hung on a wall with the front side of the frame and the first side of the photo retaining section exposed to a viewer.

15. The combination as specified in claim 7 further comprising a frame support hinge comprising:

a) a vertical member having a lower edge and a length substantially equal to the length of said frame's lower section, and b) a horizontal member having an inward edge that is frictionally hinged to the lower edge of the vertical member, where when the vertical member is attached, by an attachment means, to the back side of said frame's lower section, the horizontal member can be angularly positioned and held by friction to allow said photoframe and gift card combination to be placed upon a flat surface, and where when said combination is being stored or is in transport, the horizontal member can be positioned upward, against the vertical member.

16. The combination as specified in claim 7 wherein said means for attaching the photo retainer to the second side of the center panel of said frame comprises an adhesive.

17. The combination as specified in claim 7 further comprising a translucent material placed into the perimeter step area of said frame prior to the insertion of a photo.

18. The combination as specified in claim 7 wherein the first and second photo cutouts and the photo retainer are sized to allow a trading card to be inserted into the photo slot in the composite photo section, which allows both the front and back of the trading card to be viewed.

19. The combination as specified in claim 7 wherein said trading card is enclosed in a protective transparent cover before insertion into the photo slot.

20. The combination as specified in claim 19 wherein said transparent cover has means for being hermetically sealed.

21. The combination as specified in claim 7 wherein the perimeter step area of said frame is sized to allow a photo complimentary to the trading card to be inserted and viewed.

22. The combination as specified in claim 7 wherein the composite photo section can include on either side embellishment and indicia that indicates the purpose of said photoframe and gift card combination.

23. The combination as specified in claim 7 wherein the front sides of said frame are painted with a photoluminescent paint that luminesces for several hours after said painted frame is exposed to a light source, where said photoluminescent paint allows said photoframe to function as a night light.

24. The combination as specified in claim 7 wherein said frame sections are made of a translucent or transparent material, where to the back side of said frame sections is attached an electroluminescent tape that luminesces for several hours after said tape has been exposed to a light source, where said luminescent tape allows said photoframe to function as a night light.

25. The combination as specified in claim 7 wherein said frame sections are made of a translucent or transparent material, where to the back side of said frame sections is attached an electroluminescent panel that luminesces when said panel is connected to an electrical power source, where said luminescent panel allows said photoframe to function as a night light.

* * * * *